US008418667B2

(12) United States Patent
Nendel

(10) Patent No.: US 8,418,667 B2
(45) Date of Patent: Apr. 16, 2013

(54) VALVE TRAIN OF AN INTERNAL COMBUSTION ENGINE

(75) Inventor: Andreas Nendel, Hessdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 109 days.

(21) Appl. No.: 13/167,063

(22) Filed: Jun. 23, 2011

(65) Prior Publication Data

US 2012/0024245 A1 Feb. 2, 2012

(30) Foreign Application Priority Data

Aug. 2, 2010 (DE) ..... 10 2010 033 087

(51) Int. Cl.
*F01L 1/04* (2006.01)

(52) U.S. Cl.
USPC ..... 123/90.6; 123/90.16; 123/90.44; 29/888.1

(58) Field of Classification Search ..... 123/90.16, 123/90.44, 90.6; 29/888.1
See application file for complete search history.

(56) References Cited

U.S. PATENT DOCUMENTS 8,161,930 B2 * 4/2012 Elendt et al. ..... 123/90.6

FOREIGN PATENT DOCUMENTS

| | | |
|---|---|---|
| DE | 10148177 | 4/2003 |
| DE | 102007051739 | 5/2009 |
| DE | 102008024911 | 11/2009 |

* cited by examiner

*Primary Examiner* — Ching Chang
(74) *Attorney, Agent, or Firm* — Volpe and Koenig, P.C.

(57) ABSTRACT

A valve train of an internal combustion engine with a camshaft (1) that has a carrier shaft (2) and a cam part (3) that is locked on rotation on the carrier shaft and is arranged displaceable in the axial direction and has at least one cam group (4*a* to 4*c*, 5*a* to 5*c*) of different elevations for variable actuation of a gas-exchange valve and a groove-shaped axial connecting link (10) with two connecting-link paths (11, 12) crossing its periphery, and with two actuation pins (13, 14) that can be coupled in the connecting-link paths for displacement of the cam part in the direction of the two connecting-link paths. The axial connecting link is further provided with a third connecting-link path (20) that runs essentially equidistant to one of the two crossing connecting-link paths, and the actuation pins can be coupled simultaneously in the first connecting-link path (11) and the third connecting-link path, and the actuation pin (13) coupled in the third connecting-link path forces a further displacement of the cam part in a direction of the first connecting-link path when passing through the crossing region (16) of the first and second connecting-link paths.

7 Claims, 2 Drawing Sheets

VALVE TRAIN OF AN INTERNAL COMBUSTION ENGINE

CROSS-REFERENCE TO RELATED APPLICATIONS

This application claims the benefit of German Patent Application No. 10 2010 033 087.6, filed Aug. 2, 2010, which is incorporated herein by reference as if fully set forth.

BACKGROUND

The invention relates to a valve train of an internal combustion engine, with a camshaft that comprises a carrier shaft and a cam part that is locked in rotation on this carrier shaft and is arranged displaceable in the axial direction and has at least one cam group of directly adjacent cams of different elevations for variable actuation of a gas-exchange valve and a groove-shaped axial connecting link with two connecting-link paths crossing its periphery, and with two actuation pins that can be coupled in the connecting-link paths for displacing the cam part in the direction of the two connecting-link paths.

From DE 101 48 177 A1, a valve train with a cam part that can be displaced between two axial positions is known, whose groove-shaped, axial connecting link is composed merely from external guide walls for specifying the crossing connecting-link paths. For this open construction of the axial connecting link, however, there is considerable risk with respect to the functional safety of the valve train in that the displacement process of the cam part along the currently active connecting-link path is closed completely, i.e., free from incorrect switching, only when the inertia of the moving cam part is sufficiently large for the contact change of the actuation pin required in the crossing region of the connecting-link paths between the external guide walls. This is because, during and after this free-flight phase during the contact change, the cam part must be in the position to move into its other axial position also without positive accelerating forced action of the actuation pin. A prerequisite for sufficiently large inertia of the cam part is a minimum rotational speed of the camshaft that increases with friction between the cam part and the carrier shaft. A displacement of the cam part rotating below this minimum rotational speed can lead to the result that the cam part remains standing "halfway," namely in the crossing region of the connecting-link paths and a cam follower loading the gas-exchange valve is loaded in an uncontrolled manner by several cams of the cam group and simultaneously with high mechanical loads. In addition, in this case there is no longer the possibility to displace the cam part by the actuation pin at a later time into one of the axial positions, because then the axial allocation between the actuation pin and the external guide walls is no longer set.

For remedying this problem, in DE 10 2008 024 911 A1 it was proposed to provide the cam part with a flexible guide mechanism for the actuation pin. The guide mechanism comprises two guide vanes rotating in opposite directions for formation of inner guide walls of the axial connecting link that can move in the axial direction relative to the rigid, outer guide walls. As for a switch point, here according to the position of the guide vanes, the one connecting-link path is freed for the actuation pin and the other connecting-link path is blocked for the actuation pin. Simultaneously, the inner guide walls also cause an axial forced guidance of the cam part on the actuation pin after passing through the crossing region of the connecting-link paths, so that the displacement process of the cam part is completed without incorrect switching along the currently active connecting-link path.

A valve train according to the class with an axial connecting link having two crossing connecting-link paths and two actuation pins is known from DE 10 2007 051 739 A1. The interaction of the groove-shaped axial connecting link with the actuation pins coupled selectively therein allows the presentation of a cam group with three cams, i.e., a three-stage variable valve train. As in the first-cited publication, however, the axial connecting link has only outer guide walls, so that there is also a correspondingly high risk for incorrect switching of the cam part also for this valve train.

For complete clarification it should be noted that the terms before, in, or after the crossing region always relate to the starting position of the actuation pins relative to the axial connecting link rotating with a fixed rotational direction on the cam part.

SUMMARY

The present invention is based on the objective of developing a valve train of the type named above so that the named disadvantages are overcome with the simplest possible structural means.

The solution to meeting this objective is provided by the invention, while advantageous refinements and constructions of the invention can be taken from the description and claims. Accordingly, the axial connecting link should be provided with a third connecting-link path that runs essentially equidistant to one of the two crossing connecting-link paths. Here, the actuation pins can be coupled simultaneously in the first connecting-link path and the third connecting-link path, and the actuation pin coupled in the third connecting-link forces a further displacement of the cam part in the direction of the one connecting-link path when passing through the crossing region of the two connecting-link paths. In other words, the invention touches upon the idea of providing the section of the axial connecting link not previously used in the crossing region of the connecting-link paths with an additional connecting-link path that causes a forced displacement of the cam part along the geometrically provided connecting-link path in interaction with the second actuation pin also in and after the crossing region. Thus, on one hand, a successful displacement process is no longer dependent on the minimum rotational speed of the camshaft named above and can also be performed for an internal combustion engine that is virtually at a standstill. On the other hand, for camshaft rotational speeds above this minimum rotational speed, the interaction between the second actuation pin and the additional connecting-link path can be eliminated, when the inertia of the moving cam part is sufficient for a complete displacement process.

In a refinement of the invention it is provided that the axial connecting link is provided with a fourth connecting-link path that runs essentially equidistant to and, with respect to the third connecting-link path, on the other side of the first connecting-link path. In an analogous way to the functioning explained above, here the actuation pins can be coupled simultaneously in the first connecting-link path and the fourth connecting-link path, and the actuation pin coupled in the fourth connecting-link path forces a further displacement of the cam part in the direction of the first connecting-link path when passing through the crossing region of the two connecting-link paths. According to one embodiment of the invention explained later, such a construction of the axial connecting link and its interaction with the two actuation pins is the basis for a three-stage valve train variability in which, in one of the displacement directions, the cam part is forcibly displaced from one cam to the next.

With respect to a forced displacement of the cam part also in the other displacement direction, the second of the two crossing connecting-link paths can have a larger groove depth relative to the first connecting-link path. In this case, the second connecting-link path is specified by a closed groove with inner and outer guide walls, so that the actuation pin coupled in the second connecting-link path forces a further displacement of the cam part in the direction of the second connecting-link path after passing through the crossing region of the two connecting-link paths.

In order to prevent, to a large degree, an undesired locking of the actuation pin currently moving along the first connecting-link path in the crossing region of the connecting-link paths in the larger groove depth of the second connecting-link path, the first connecting-link path should have a groove depth that is smaller, directly before the crossing region of the two connecting-link paths, than directly after the crossing region of the two connecting-link paths.

In addition, the third connecting-link path should have a groove depth that is smaller, in the crossing region of the two connecting-link paths, than each groove depth of the two crossing connecting-link paths. The background of this construction is to impart, to an outer guide wall of the connecting-link path running before the crossing region of the connecting-link paths, sufficient mechanical stability against transverse forces of the actuation pin guided along this path. A corresponding situation applies for the construction of the axial connecting link with the additional, fourth connecting-link path, wherein advantageously the groove depths of the third connecting-link path and the fourth connecting-link path are essentially equal in the crossing region of the two connecting-link paths.

BRIEF DESCRIPTION OF THE DRAWINGS

Additional features of the invention are given from the following description and from the drawings in which an embodiment of the invention is shown partially schematically or simplified. As long as not otherwise mentioned, components or features that are identical or have identical functions are provided with identical reference numbers. Shown are.

DETAILED DESCRIPTION OF THE PREFERRED EMBODIMENTS

Figure 5:
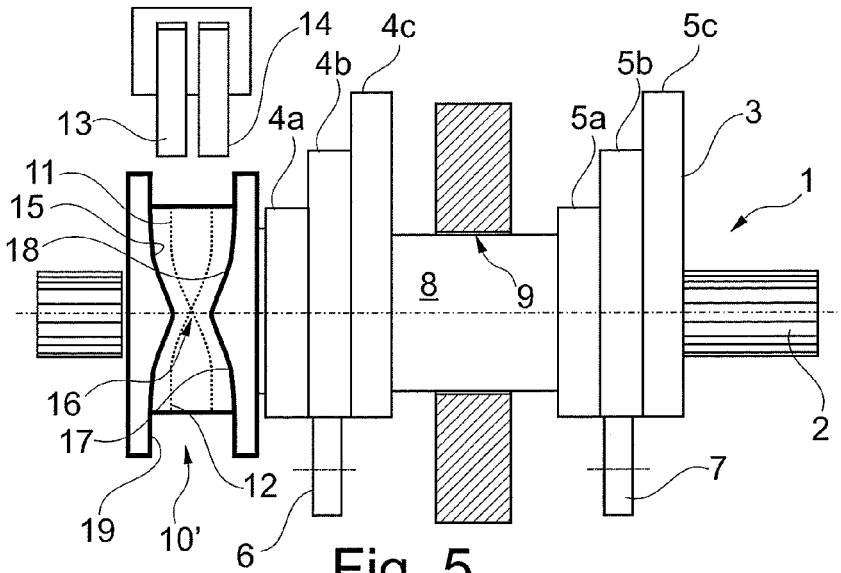
FIG. 5 is a view of a known valve train with three-stage stroke variability.

For better understanding, the invention shall be explained starting from FIG. 5 in which a section of a known variable valve train of an internal combustion engine according to DE 10 2007 051 739 A1 cited above is shown. The valve train has a camshaft 1 that comprises a carrier shaft 2 and a cam part 3 that is locked in rotation on this carrier shaft and is arranged displaceable in the axial direction. For this purpose, the carrier shaft 2 is provided with external longitudinal teeth and the cam part 3 is provided with corresponding internal longitudinal teeth. The teeth are known and can be recognized here only on the carrier shaft 2. The cam part 3 has two cam groups of directly adjacent cams 4*a* to 4*c* and 5*a* to 5*c* each with identical root circle radii and different elevations. The transfer of the elevation currently active as a function of the axial position of the cam part 3 to not-shown gas-exchange valves is performed via cam followers 6 and 7 that are only indicated here and can be constructed, in a known way, as levers supported so that they can pivot in the internal combustion engine or also as longitudinally guided tappets each with a cam rolling or a cam sliding tappet. The different elevations of the cams 4*a* to 4*c* and 5*a* to 5*c* are to be understood as either different magnitudes of each cam stroke and/or different valve timing of the cams. A cylindrical section 8 running between the two cam groups is used for supporting the cam part 3 in a camshaft bearing point 9 arranged stationary in the internal combustion engine.

For the displacement of the cam part 3 for the purpose of switching each of the cams 4*b* and 5*b* currently active in the figure to one of the adjacent cams 4*a* or 4*c* and 5*a* or 5*c*, respectively, the cam part 3 have a groove-shaped axial connecting link 10' with two crossing connecting-link paths 11 and 12. These are symbolized by dotted center point paths of actuation pins 13 and 14 of an actuator which are traversed for the actuation pins coupled selectively in the axial connecting link 10' relative to the axial connecting link 10' and are mirror-inverted to each other.

The average distance of the cylindrical actuation pins 13, 14 and consequently their center point paths 11, 12 at the beginning and at the end of the displacement process of the cam part 3 are essentially identical to each average distance of the cams 4*a* to 4*c* and 5*a* to 5*c*.

Below, the interaction of the two actuation pins 13, 14 with the axial connecting link 10' for displacement of the cam part 3 during the common root circle phase of the cams 4*a* to 4*c* and 5*a* to 5*c* is explained. The starting position should be the shown state in which the actuation pins 13, 14 are located in the retracted state out of engagement from the axial connecting link 10'. A displacement of the cam part 3 toward the left, i.e., a switching of the currently active cams 4*b* and 5*b* to the cams 4*c* and 5*c*, is initiated by coupling the actuation pin 13 in the one connecting-link path 11. The rotating cam part 3 simultaneously shifted toward the left in the axial direction on the carrier shaft 2 is supported initially with an acceleration flank 15 and then, after passing through the crossing region 16 of the connecting-link paths 11, 12, due to its axial inertia, with a deceleration flank 17 on the actuation pin 13. Shifting the cam part 3 back toward the right, i.e., back into the shown starting position, is performed by coupling the same actuation pin 13 in the other connecting-link path 12, wherein now the cam part 3 is supported on an acceleration flank 18 and then, after passing through the crossing region 16 with corresponding contact change, on a deceleration flank 19 on the actuation pin 13.

A displacement of the cam part 3 from the shown starting position toward the right, i.e., a switching of the currently active cams 4*b* and 5*b* to the cams 4*a* and 5*a*, is performed in an analogous way, wherein, in this case, the actuation pin 14 is coupled in the connecting-link path 12 and the cam part 3 is supported on the actuation pin 14 via the acceleration flank 18 and the deceleration flank 19. Shifting the cam part 3 back into the shown starting position is performed by coupling the actuation pin 14 in the connecting-link path 11, whereupon the cam part 3 is shifted toward the left supported on the actuation pin 14 with the acceleration flank 15 and the deceleration flank 17.

The necessary resetting of the actuation pins 13, 14 after completion of a displacement process of the cam part 3 into its shown decoupled position can be produced either actively by the actuation pins 13, 14 themselves or by a suitable radial profiling not shown in more detail here of the axial connecting link 10'. For such radial profiling, as known, for example, from DE 101 48 177 A1 cited above, the connecting-link paths 11, 12 are provided in the rotational direction of the cam part 3 before the acceleration flanks 15 and 18, as well as behind the deceleration flanks 17 and 19 with inlet ramps falling in the radial direction or outlet ramps rising in the radial direction. The latter provide for a pushing back of the actuation pins 13, 14 into the shown decoupled position.

The axial connecting link 10' has an open construction such that the connecting-link paths 11, 12 are limited in the axial direction only by external guide walls, namely the acceleration flanks 15, 18 and the deceleration flanks 17, 19. As previously explained, the axial inertia of the cam part 3 is dependent on its rotational speed and the minimum rotational speed required for the complete displacement process of the cam part 3 is decisively dependent on the teeth friction between cam part 3 and carrier shaft 2. A rotational speed that is too low could prevent the contact change of the current active actuation pin 13 or 14 necessary in the crossing region 16 between the acceleration flank 15 or 18 and the deceleration flank 17 or 19. Independence, to a large extent, from rotational speed of the displacement process is achieved by the interaction of a modified, axial connecting link according to the invention with two actuation pins. This should be explained below with reference to FIGS. 1 to 4.

Figure 1:
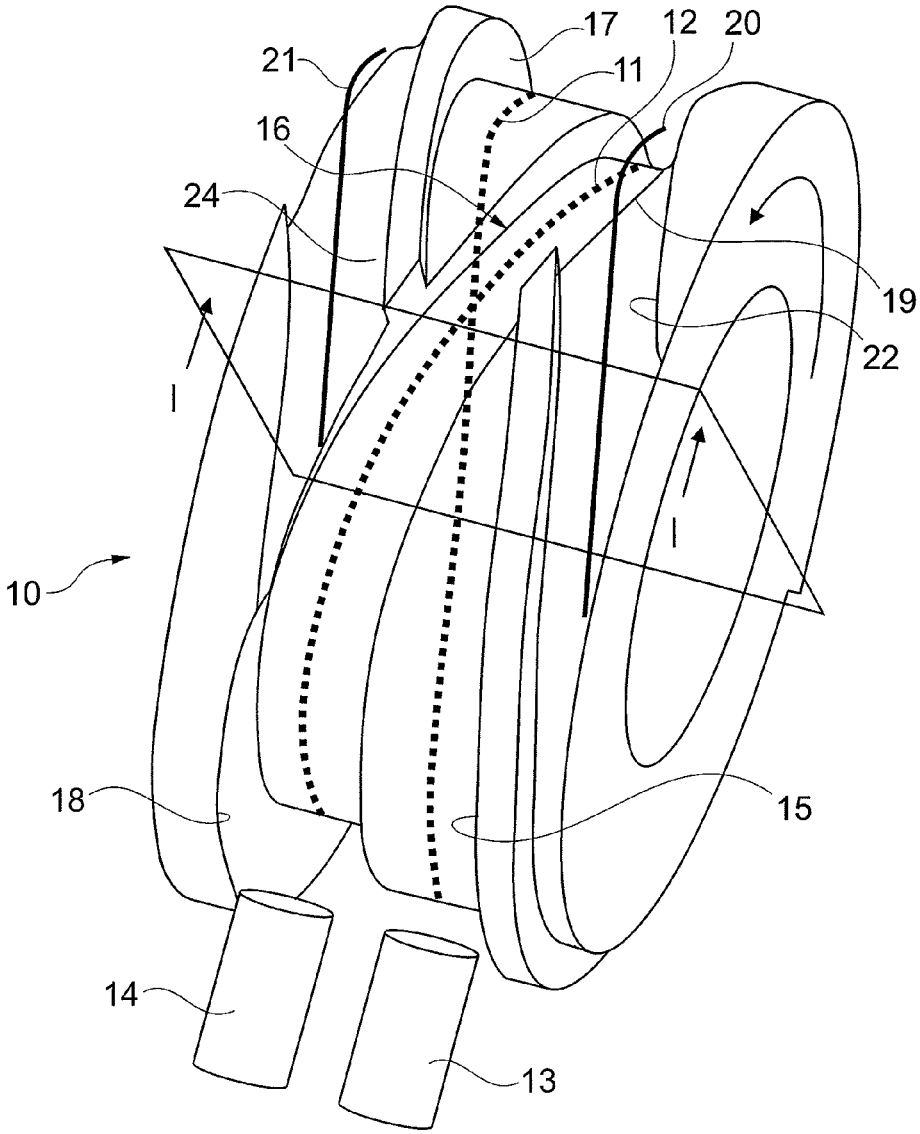
FIG. 1 is an isolated perspective view of an axial connecting link according to the invention of a three-stage, variable-stroke valve train.

FIG. 1 shows the modified axial connecting link 10 for a three-stage variable stroke valve train according to FIG. 5 whose rotational direction is characterized by the arrow drawn on the end. The axial connecting link 10 is also provided, in addition to the two crossing connecting-link paths 11, 12, with a third connecting-link path 20 and a fourth connecting-link path 21, which are each symbolized with solid lines. The third and the fourth connecting-link paths 20 and 21, respectively, are specified by additional grooves that are entered or exited at the ends of the axial connecting link 10 with respect to its rotational direction. They run on both sides of the first connecting-link path 11 and essentially equidistant to this path and cause, in the interaction with the actuation pins 13, 14 explained below, a forced displacement of the cam part along the first connecting-link path 11, so that the cam part 3 is also shifted farther to the right in FIG. 1 and after passing through the crossing region 16. As also becomes clear from FIGS. 3*a* and 4*a*, the third and second other connecting-link path 20 and 12, respectively, have an essentially identical path profile after the crossing region 16, while the path profile of the fourth and the second connecting-link path 21 and 12, respectively, is essentially identical before the crossing region 16. Accordingly, the distance of the third and fourth connecting-link path 20 and 21, respectively, to the first connecting-link path 11 each corresponds to the average distance of the actuation pins 13 and 14.

Figure 2:
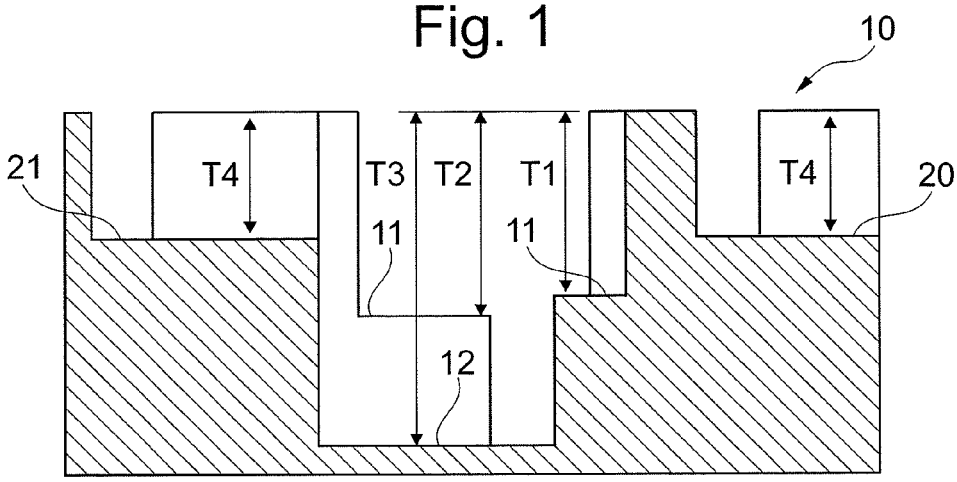
FIG. 2 is a view of section I-I through the axial connecting link according to FIG. 1.

The groove-shaped construction of all of the connecting-link paths 11, 12, 20, 21 starts from the longitudinal section I-I shown in FIG. 2 through the axial connecting link 10 shortly before the crossing point of the two connecting-link paths 11, 12. The groove depth of the first connecting-link path 11 is smaller, with T1, directly before the crossing point, than, with T2, directly after and significantly smaller than the groove depth T3 of the second connecting-link path 12, i.e. the following relationships apply a.) T1<T2 and b.) T1, T2<<T3. The background of this construction is the active direction only on one side of the third and fourth connecting-link path 20 or 21, wherein a forced displacement of the cam part 3 in the opposite direction—in FIG. 1 toward the left—is generated by the two-sided guide walls of the other connecting-link path 12 running significantly deeper. Through the depth jump from T1 to T2, the risk of locking or jamming in the (deep) second connecting-link path 12 of an actuation pin 13 or 14 currently traversing the first connecting-link path 11 is considerably reduced.

The third and the fourth connecting-link path 20 and 21, respectively, have the same and relatively small groove depth T4 in the crossing region 16 and the following relationship applies: T4<T1, T2, T3. This construction causes an increased mechanical stability of the acceleration flanks 15, 18 and the deceleration flanks 17, 19.

Figure 3A:
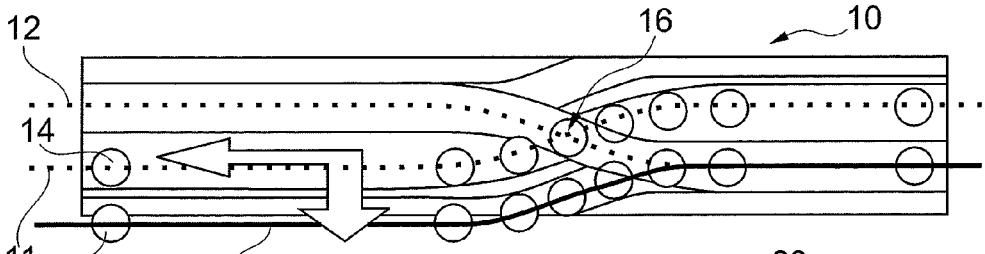
FIG. 3*a* is a view showing as a development, the axial connecting link according to FIG. 1 in interaction with the two actuation pins for a displacement of the cam part from the first axial position into the middle axial position.
Figure 3B:
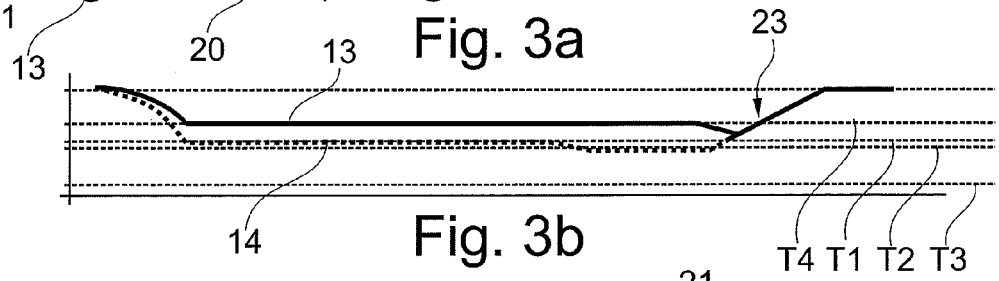
FIG. 3*b* is a view showing the peripheral-related radial stroke profile belonging to this first displacement for the actuation pins in relation to the groove depths of the connecting-link paths.

The interaction of the actuation pins 13, 14 with the axial connecting link 10 at small camshaft rotational speeds is shown in FIGS. 3 and 4. FIG. 3*a* shows the displacement process of the axial connecting link 10 from the first into the middle axial position of the cam part 3 corresponding to the perpendicular arrow direction. Here, the actuation pin 14 is coupled in the first connecting-link path 11 and the actuation pin 13 is coupled in the third connecting-link path 20. FIG. 3*b* shows the corresponding penetration profile of the actuation pins 13, 14 in the axial connecting link 10 with the drawn groove depths T1 to T4. The axial connecting link 10 rotating in the horizontal arrow direction is supported initially with the acceleration flank 15 (see FIG. 1) on the actuation pin 14 and here shifts downward, while the actuation pin 13 tracks into the third connecting-link path 20. During and after the traversal of the crossing region 16 of the first two connecting-link paths 11, 12, the axial connecting link 10 is supported on the groove wall 22 (see FIG. 1) of the third connecting-link path 20 and shifts farther downward. Here, the actuation pin 14 follows the first connecting-link path 11 along the deceleration flank 17 (see FIG. 1). The displacement process of the cam part 3 by a cam width is completed when both actuation pins 13, 14 are shifted back into their decoupled rest position through outlet ramps 23 rising in the radial direction of the connecting-link paths 11, 20 (see FIG. 5).

Figure 4A:
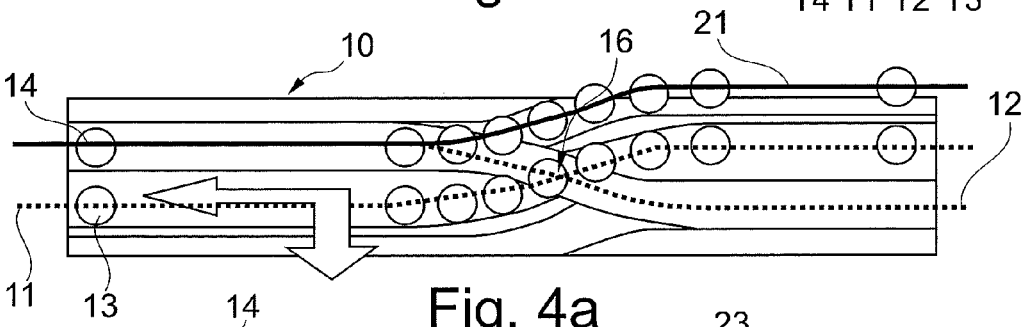
FIG. 4*a* is a view analogous to FIG. 3*a*, showing the displacement of the cam part from the middle axial position into the third axial position.
Figure 4B:
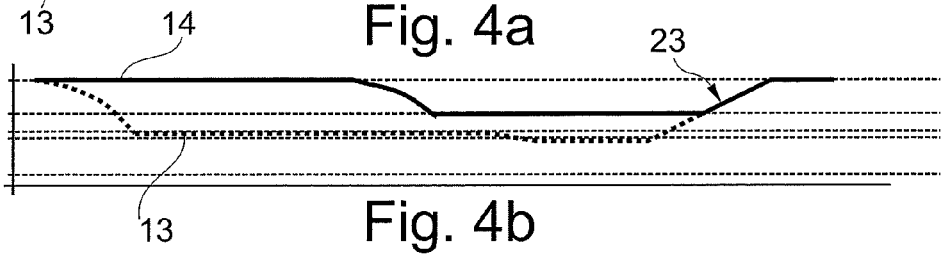
FIG. 4*b* is a view analogous to FIG. 3*b*, showing the radial stroke profile belonging to this second displacement for the actuation pins.

Analogous to FIG. 3*a*, FIG. 4*a* shows the displacement process of the axial connecting link 10 from the middle into the third axial position of the cam part 3. Here, the actuation pin 13 is coupled in the first connecting-link path 11 and the actuation pin 14 is coupled in the fourth connecting-link path 21. Analogous to FIG. 3*b*, FIG. 4*b* shows the corresponding penetration profile of the actuation pins 13, 14 in the axial connecting link 10. In this case, however, the radial coupling of the actuation pin 14 in the fourth connecting-link path 21 takes place first in the crossing region 16 of the two connecting-link paths 11, 12, in order to prevent a collision of the actuation pin 14 with the acceleration flank 18 (see FIG. 1) of the second connecting-link path 12. The axial connecting link 10 is initially supported with the acceleration flank 15 (see FIG. 1) on the actuation pin 13 and here shifts downward, while the actuation pin 14 tracks into the fourth connecting-link path 21. During and after passing through the crossing region 16 of the first two connecting-link paths 11, 12, the axial connecting link 10 is supported on the groove wall 24 (see FIG. 1) of the fourth connecting-link path 21 and shifts farther downward. Here, the actuation pin 13 of the provided connecting-link path 11 follows along the deceleration flank 17 (see FIG. 1). The displacement process of the cam part 3 by an additional cam width is completed when both actuation pins 13, 14 are shifted back into their decoupled rest positions through the outlet ramps 23 of the connecting-link paths 11, 21.

The reverse displacement process back into the middle and the first axial position of the cam part 3 is performed by coupling the actuation pin 13 or 14 into the second connecting-link path 12 that represents, due to its closed groove shape with the groove depth T3, a permanent forced guidance for each coupled actuation pin 13 or 14.

List of Reference Symbols

1 Camshaft
2 Carrier shaft
3 Cam part
4 Cam
5 Cam
6 Cam follower
7 Cam follower
8 Cylindrical section
9 Camshaft bearing point
10 Axial connecting link
11 First connecting-link path
12 Second connecting-link path
13 Actuation pin
14 Actuation pin
15 Acceleration flank
16 Crossing region of the connecting-link paths
17 Deceleration flank
18 Acceleration flank
19 Deceleration flank
20 Third connecting-link path
21 Fourth connecting-link path
22 Groove wall of the third connecting-link path
23 Outlet ramp
24 Groove wall of the fourth connecting-link path
T1-T4 Groove depth

The invention claimed is:

1. A valve train of an internal combustion engine, comprising a camshaft that comprises a carrier shaft and a cam part that is locked in rotation on the carrier shaft and is arranged to be displaceable in an axial direction and has at least one cam group of directly adjacent cams of different elevations for variable actuation of a gas-exchange valve and a grooved, axial connecting link with connecting link paths, and two actuation pins that can be coupled in the connecting link paths for displacement of the cam part in the direction of the connecting link paths, the connecting link paths on the grooved axial connecting link include first and second connecting-link paths crossing on a periphery thereof, and a third connecting-link path that runs essentially equidistant to one of the first and second connecting-link paths, wherein the actuation pins are simultaneously coupleable in the first connecting-link path and the third connecting-link path, and the actuation pin coupled in the third connecting-link path forces a further displacement of the cam part in a direction of the first connecting-link path when passing through a crossing region of the first and second connecting-link paths.

2. The valve train according to claim 1, wherein the axial connecting link further comprises a fourth connecting-link path that runs essentially equidistant to and, with respect to the third connecting-link path, on the other side of the first connecting-link path, wherein the actuation pins are coupleable simultaneously in the first connecting-link path and the fourth connecting-link path, and the actuation pin coupled in the fourth connecting-link path forces a further displacement of the cam part in a direction of the first connecting-link path when passing through the crossing region of the first and second connecting-link paths.

3. The valve train according to claim 2, wherein the fourth connecting-link path has a groove depth (T4) that is smaller, in the crossing region of the first and second connecting-link paths, than each groove depth (T1, T2, T3) of the first and second connecting-link paths.

4. The valve train according to claim 3, wherein the groove depths (T4) of the third connecting-link path and of the fourth connecting-link path in the crossing region of the first and second connecting-link paths are essentially equal.

5. The valve train according to claim 1, wherein the second connecting-link path has a greater groove depth (T3) relative to the first connecting-link path, and the actuation pin coupled in the second connecting-link path forces a further displacement of the cam part in the direction of the second connecting-link path when passing through the crossing region of the first and second connecting-link paths.

6. The valve train according to claim 5, wherein the first connecting-link path has a groove depth (T1, T2) that is smaller, directly before the crossing region of the first and second connecting-link paths, than directly after the crossing region of the first and second connecting-link paths.

7. The valve train according to claim 1, wherein the third connecting-link path has a groove depth (T4) that is smaller, in the crossing region of the first and second connecting-link paths, than each groove depth (T1, T2, T3) of the first and second connecting-link paths.

* * * * *